US009809443B2

(12) United States Patent
Bertucci et al.

(10) Patent No.: US 9,809,443 B2
(45) Date of Patent: Nov. 7, 2017

(54) MULTI-STATION LIQUID DISPENSING APPARATUS WITH AUTOMATIC SELECTION OF PROPER FLOW RATE

(71) Applicant: Diversey, Inc., Sturtevant, WI (US)

(72) Inventors: Michael H. Bertucci, Gurnee, IL (US); Curtis H. Hubmann, Racine, WI (US); Christopher F. Lang, Racine, WI (US); Steven E. Schiller, Kenosha, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 15/369,408

(22) Filed: Dec. 5, 2016

(65) Prior Publication Data

US 2017/0081170 A1 Mar. 23, 2017

Related U.S. Application Data

(63) Continuation of application No. 14/930,195, filed on Nov. 2, 2015, now abandoned, which is a (Continued)

(51) Int. Cl.
*B65B 1/04* (2006.01)
*B67D 7/74* (2010.01)
(Continued)

(52) U.S. Cl.
CPC ..... *B67D 7/741* (2013.01); *B01F 3/08* (2013.01); *B01F 3/088* (2013.01); *B01F 3/0865* (2013.01);
(Continued)

(58) Field of Classification Search
CPC ..... B01F 3/08; B01F 3/0865; B01F 5/043; B01F 5/0413; B01F 15/0222; B01F 2003/0896; B67D 7/741
(Continued)

(56) References Cited

U.S. PATENT DOCUMENTS

D118,448 S 1/1940 Helms
2,881,802 A 4/1959 Crawford
(Continued)

FOREIGN PATENT DOCUMENTS

AU 2006280234 2/2008
BR PI0614689-9 4/2011
(Continued)

OTHER PUBLICATIONS

Office Action from the U.S. Appl. No. 14/166,544 dated Dec. 15, 2016 (7pages).
(Continued)

*Primary Examiner* — Jason K Niesz
(74) *Attorney, Agent, or Firm* — Michael Best & Friedrich LLP

(57) ABSTRACT

A multi-station liquid mixing and dispensing apparatus. The apparatus includes a housing that defines a first pocket for supporting a first container, a second pocket for supporting a second container, and a third pocket disposed vertically above at least one of the first pocket and the second pocket. The apparatus also includes a first door pivotably coupled to the housing and enclosing the first pocket, and a second door pivotably coupled to the housing and enclosing the second pocket. The apparatus also includes a valve coupled to the housing to control flow of chemical concentrate to at least one of the first container and the second container.

20 Claims, 7 Drawing Sheets

Related U.S. Application Data continuation of application No. 14/083,810, filed on Nov. 19, 2013, now Pat. No. 9,174,179, which is a continuation of application No. 13/164,260, filed on Jun. 20, 2011, now Pat. No. 8,584,716, which is a continuation of application No. 12/397,110, filed on Mar. 3, 2009, now Pat. No. 7,963,304, which is a continuation of application No. 11/203,315, filed on Aug. 12, 2005, now Pat. No. 7,516,763.

(60) Provisional application No. 60/707,399, filed on Aug. 11, 2005.

(51) Int. Cl.

| | |
|---|---|
| ***B01F 3/08*** | (2006.01) |
| ***B01F 5/04*** | (2006.01) |
| ***B01F 13/10*** | (2006.01) |
| ***B67D 7/02*** | (2010.01) |
| ***B01F 5/08*** | (2006.01) |
| ***B01F 15/02*** | (2006.01) |
| ***B67D 7/36*** | (2010.01) |

(52) U.S. Cl.

CPC ..... *B01F 5/043* (2013.01); *B01F 5/0413* (2013.01); *B01F 5/08* (2013.01); *B01F 13/1055* (2013.01); *B01F 15/0222* (2013.01); *B67D 7/02* (2013.01); *B67D 7/36* (2013.01); *B01F 2003/0896* (2013.01); *B01F 2215/004* (2013.01); *Y10T 137/87684* (2015.04)

(58) Field of Classification Search

USPC ..... 141/360, 18, 9, 100, 104; 222/144.5, 222/331, 132, 129.2, 145.1, 481; 239/304, 305, 310, 318, 74

See application file for complete search history.

(56) References Cited

U.S. PATENT DOCUMENTS

| | | | |
|---|---|---|---|
| 3,610,535 | A | 10/1971 | Bradshaw |
| 3,618,637 | A | 11/1971 | Santomieri |
| 3,651,991 | A | 3/1972 | Ohlson et al. |
| D235,388 | S | 6/1975 | Taylor |
| 3,976,227 | A | 8/1976 | Ray |
| 4,356,937 | A | 11/1982 | Simon et al. |
| 5,033,649 | A | 7/1991 | Copeland et al. |
| 5,129,434 | A | 7/1992 | Whigham et al. |
| 5,159,958 | A | 11/1992 | Sand |
| 5,253,677 | A | 10/1993 | Sand |
| 5,259,557 | A | 11/1993 | Spriggs et al. |
| 5,344,074 | A | 9/1994 | Spriggs et al. |
| 5,351,875 | A | 10/1994 | Rhine et al. |
| 5,377,718 | A | 1/1995 | Sand |
| 5,400,839 | A | 3/1995 | Cravett |
| 5,452,825 | A | 9/1995 | Comstock et al. |
| D367,659 | S | 3/1996 | Baker et al. |
| 5,522,419 | A | 6/1996 | Sand |
| 5,570,816 | A | 11/1996 | LaBarbera, Jr. |
| 5,584,327 | A | 12/1996 | Thomas et al. |
| 5,653,261 | A | 8/1997 | Dalhart et al. |
| D385,746 | S | 11/1997 | Fritz |
| 5,799,831 | A | 9/1998 | Spriggs et al. |
| 5,832,972 | A | 11/1998 | Thomas et al. |
| 5,862,829 | A | 1/1999 | Sand |
| D407,092 | S | 3/1999 | Weaver |
| D408,207 | S | 4/1999 | Bourke |
| 5,902,041 | A | 5/1999 | Parsons et al. |
| 5,927,338 | A | 7/1999 | Boticki et al. |
| 5,957,152 | A | 9/1999 | Dalhart |
| 6,095,372 | A | 8/2000 | Dorsey et al. |
| 6,227,745 | B1 | 5/2001 | Privett |
| 6,238,081 | B1 | 5/2001 | Sand |
| 6,279,598 | B1 | 8/2001 | Boticki et al. |
| 6,299,035 | B1 | 10/2001 | Dalhart |
| 6,322,242 | B1 | 11/2001 | Lang et al. |
| 6,363,977 | B1 | 4/2002 | Smeller et al. |
| 6,398,134 | B1 | 6/2002 | Hickson et al. |
| 6,412,527 | B1 | 7/2002 | Brice |
| 6,439,272 | B1 | 8/2002 | Wertheim |
| 6,499,872 | B2 | 12/2002 | Sand |
| 6,532,998 | B2 * | 3/2003 | Beldham ..... B65B 3/22 141/100 |
| 6,571,805 | B2 | 6/2003 | Hoenisch et al. |
| 6,588,466 | B1 | 7/2003 | Lohr |
| 6,619,318 | B2 | 9/2003 | Dalhart et al. |
| 6,634,376 | B2 | 10/2003 | Haas |
| 6,655,401 | B2 | 12/2003 | Sand et al. |
| 6,763,860 | B2 | 7/2004 | Jungmann et al. |
| 6,789,708 | B2 | 9/2004 | Hansen |
| D498,637 | S | 11/2004 | Heilstedt et al. |
| D499,599 | S | 12/2004 | Morrison |
| 7,004,355 | B1 | 2/2006 | Crisp, III et al. |
| D523,878 | S | 6/2006 | Quinlan et al. |
| D544,287 | S | 6/2007 | Joss et al. |
| D555,287 | S | 11/2007 | Long et al. |
| D555,413 | S | 11/2007 | Lin |
| D555,415 | S | 11/2007 | Lin |
| 7,331,488 | B2 | 2/2008 | Naslund et al. |
| D571,598 | S | 6/2008 | Moore |
| D589,738 | S | 4/2009 | Michler |
| D589,988 | S | 4/2009 | Martin et al. |
| 7,516,763 | B2 | 4/2009 | Bertucci et al. |
| D608,129 | S | 1/2010 | Spear et al. |
| D619,151 | S | 7/2010 | Tsuji |
| D620,302 | S | 7/2010 | Picozza et al. |
| 7,963,304 | B2 | 6/2011 | Bertucci et al. |
| D652,674 | S | 1/2012 | Bertucci et al. |
| 8,186,383 | B2 | 5/2012 | Schiller et al. |
| D666,868 | S | 9/2012 | Bertucci et al. |
| 8,584,716 | B2 | 11/2013 | Bertucci et al. |
| 8,636,031 | B2 | 1/2014 | Schiller et al. |
| 2001/0042759 | A1 | 11/2001 | Dion |
| 2003/0056841 | A1 | 3/2003 | Dalhart et al. |
| 2004/0065673 | A1 | 4/2004 | Hansen |
| 2004/0094226 | A1 | 5/2004 | Wertheim |
| 2004/0163720 | A1 | 8/2004 | Joung |
| 2005/0150572 | A1 | 7/2005 | Beldham et al. |
| 2006/0048820 | A1 | 3/2006 | Horner et al. |
| 2006/0174778 | A1 | 8/2006 | Greiwe |
| 2006/0174779 | A1 | 8/2006 | Ng |
| 2007/0028980 | A1 | 2/2007 | Lohr et al. |
| 2010/0024915 | A1 | 2/2010 | Thomas et al. |
| 2010/0276452 | A1 | 11/2010 | Vesborg et al. |
| 2014/0158209 | A1 | 6/2014 | Schiller |

FOREIGN PATENT DOCUMENTS

| | | |
|---|---|---|
| CA | 2618642 | 2/2007 |
| CN | 101326390 | 10/2011 |
| DE | 19736982 | 8/1998 |
| EP | 0068906 | 1/1983 |
| EP | 1945978 | 10/2009 |
| FR | 2130157 | 11/1972 |
| JP | 63210485 | 9/1988 |
| JP | 2002/332670 | 11/2002 |
| JP | 2003/027541 | 1/2003 |
| JP | 2004/509020 | 3/2004 |
| JP | 2004/156387 | 6/2004 |
| JP | 2008/526084 | 7/2008 |
| KR | 10-2008-7005786 | 5/2008 |
| WO | WO 9114647 | 10/1991 |
| WO | WO 0222444 | 3/2002 |
| WO | WO 0240178 | 5/2002 |
| WO | WO 02070397 | 9/2002 |
| WO | WO 2004/031634 | 4/2004 |

(56) References Cited

FOREIGN PATENT DOCUMENTS

| | | |
|---|---|---|
| WO | PCT/US2006/030399 | 8/2006 |
| WO | WO 2007/021561 | 2/2007 |

OTHER PUBLICATIONS

Examination Report from the Patent Office of the Government of India for Ref No. POD/Application No./1019/KOLNP/2008 dated Jul. 14, 2016 (8 pages).

Office Action from the U.S. Appl. No. 14/166,544 dated Mar. 22, 2016 (7pages).

Johnson Wax, "Innovative Dilution Control Systems" brochure (2000) showing the Select Dispensing Unit and the Quattro Solutions Center (9 pages).

PCT/US2006/030399 International Search Report and Written Opinion dated Dec. 22, 2006 (8 pages).

* cited by examiner

MULTI-STATION LIQUID DISPENSING APPARATUS WITH AUTOMATIC SELECTION OF PROPER FLOW RATE

BACKGROUND OF THE INVENTION

This invention relates generally to liquid handling and more particularly, to combining and dispensing multiple liquids in a manner that the usage is simplified and maintenance is substantially reduced.

In the maintenance of large buildings such as office buildings or stores in shopping centers, it is customary to mix the required cleaning agents from a source of concentrate with water. The resulting solutions are then filled into suitable containers such as bottles or buckets. Apparatuses of this type are available from JohnsonDiversey, Inc. of Sturtevant, Wis., as the Quattro SS Solutions Center, J-Fill Select and Taski Ultra Easy.

While the previously described units afford accurate, reliable and safe dispensing of solutions, their operating could be simplified as well as their maintenance. For example, these apparatuses require the hand movement of one knob or button for selection of concentrates and the movement of a valve or another button for flow of water.

It would simplify the operation of these types of apparatuses if only a single selector knob had to be manipulated and a valve could be activated by a container or a trigger.

The objects of the invention therefore are:

a. Providing an improved liquid mixing and dispensing apparatus.

b. Providing a liquid mixing and dispensing apparatus which allows for easier filling of containers.

c. Providing a liquid mixing and dispensing apparatus of the foregoing type which reduces labor costs to repair.

d. Providing a liquid mixing and dispensing apparatus of the foregoing type which minimizes training.

e. Providing a liquid mixing and dispensing apparatus of the foregoing type which improves work productivity.

SUMMARY OF THE INVENTION

The foregoing objects are accomplished and the shortcomings of the prior art are overcome by the multi-station liquid mixing and dispensing apparatus of the invention which includes a support member with a plurality of containers placed on the support member. There are first and second valve members with one of the first and second valve members being container activated. A liquid intake manifold is connected to the first and second valve members. There are first and second eductors, one of the eductors having a flow rate slower than the other with the first and second valve members connected to the first and second eductors. A multi-port valve member is connected to the first and second eductors. A liquid product supply line is operatively connected to each container and to the multi-port valve member. Liquid outlet lines are connected to the first and second eductors. The first and second valve members and the first and second eductors are constructed and arranged so that when one of the first and second valve members is container activated, liquid flows to the eductor with the slower flow rate and when the other of the first and second valve members is activated, liquid flows to the other eductor.

In a preferred embodiment, there is a bar member and linkage connecting the bar member to the container activated valve and a valve activating member connected to the other of the first and second valve members, wherein the valve activating member includes a trigger and cable member.

In another preferred embodiment, the multi-port valve is operated by a single selector member.

In one aspect, one of the first and second eductors has a flow rate of 1.0 to 1.7 gpm to provide a slow flow and the other eductor has a flow rate of 3.0 to 4.0 gpm to provide a fast flow rate.

In another aspect, the support member has a multiplicity of pockets to support a plurality of containers.

In still another aspect, there is a drip tray positioned at a bottom of the pocket for a container.

In yet another aspect, the pockets include product identification windows, the pockets for the containers are housed in door members, and the door members are composed of stainless steel or powder coated mild steel with the doors attached to a molded cabinet.

DESCRIPTION OF THE PREFERRED EMBODIMENT

Figure 1:
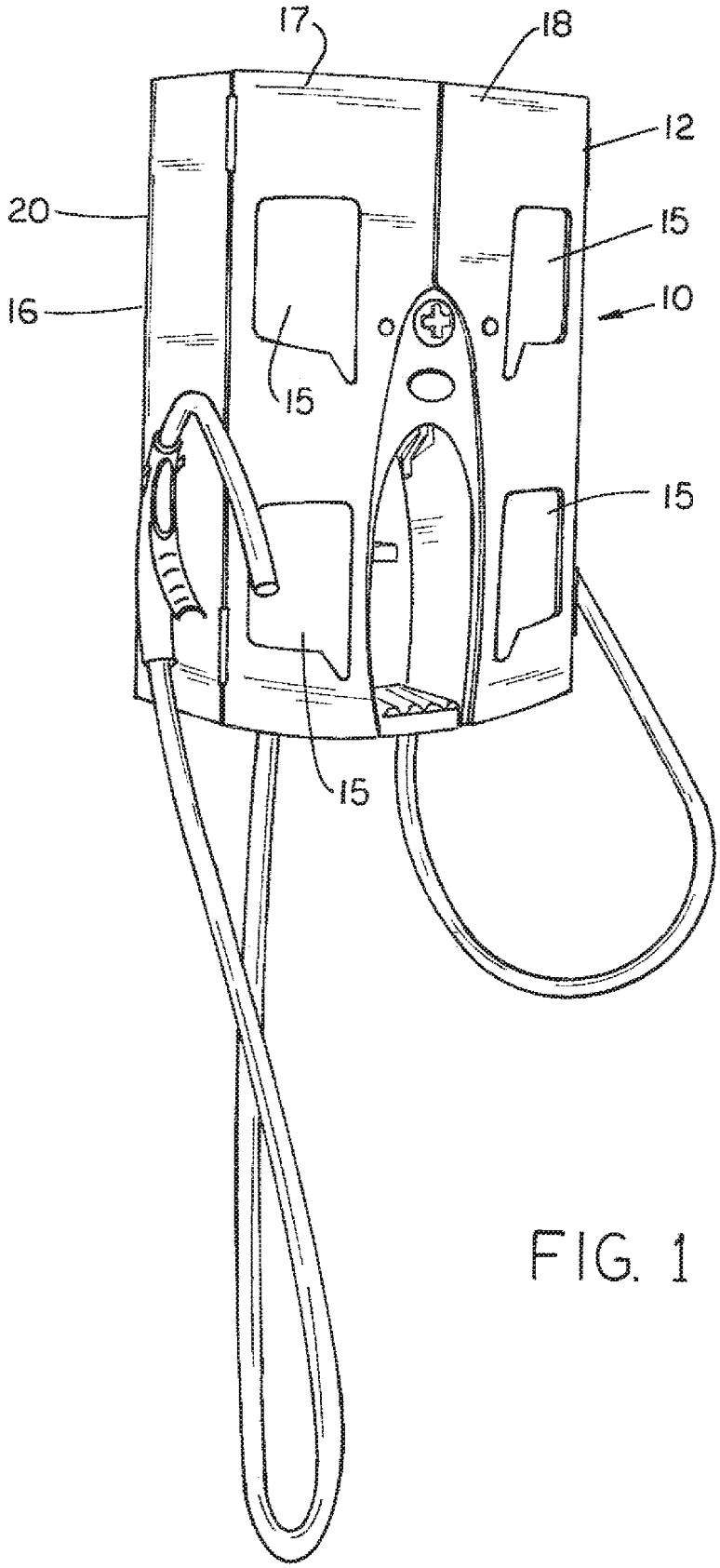
FIG. 1 is a perspective view of the multi-station liquid dispensing apparatus.
Figure 2:
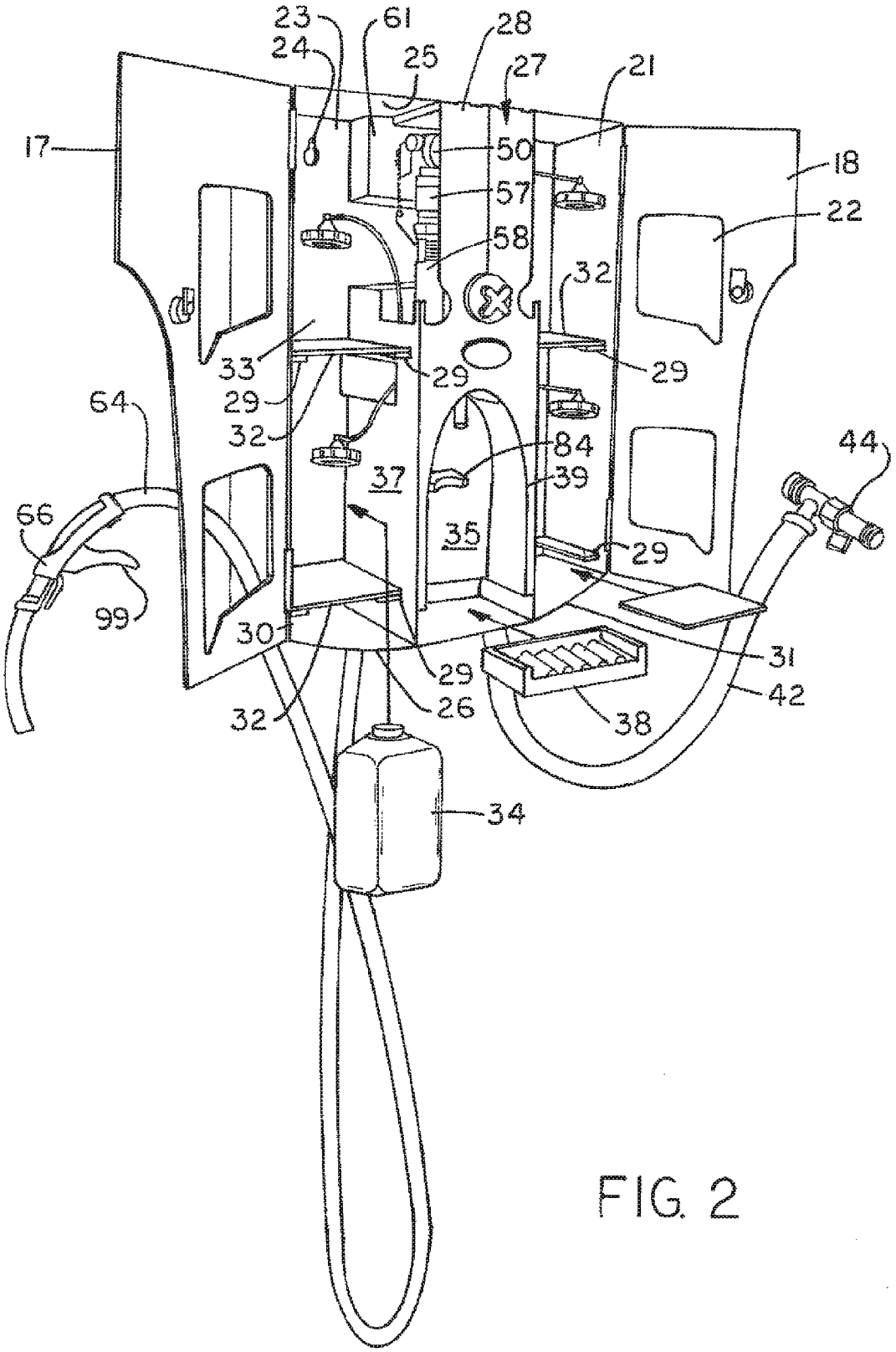
FIG. 2 is a view similar to FIG. 1 showing the doors of the cabinet of the apparatus in an open condition for viewing the inside thereof.
Figure 3:
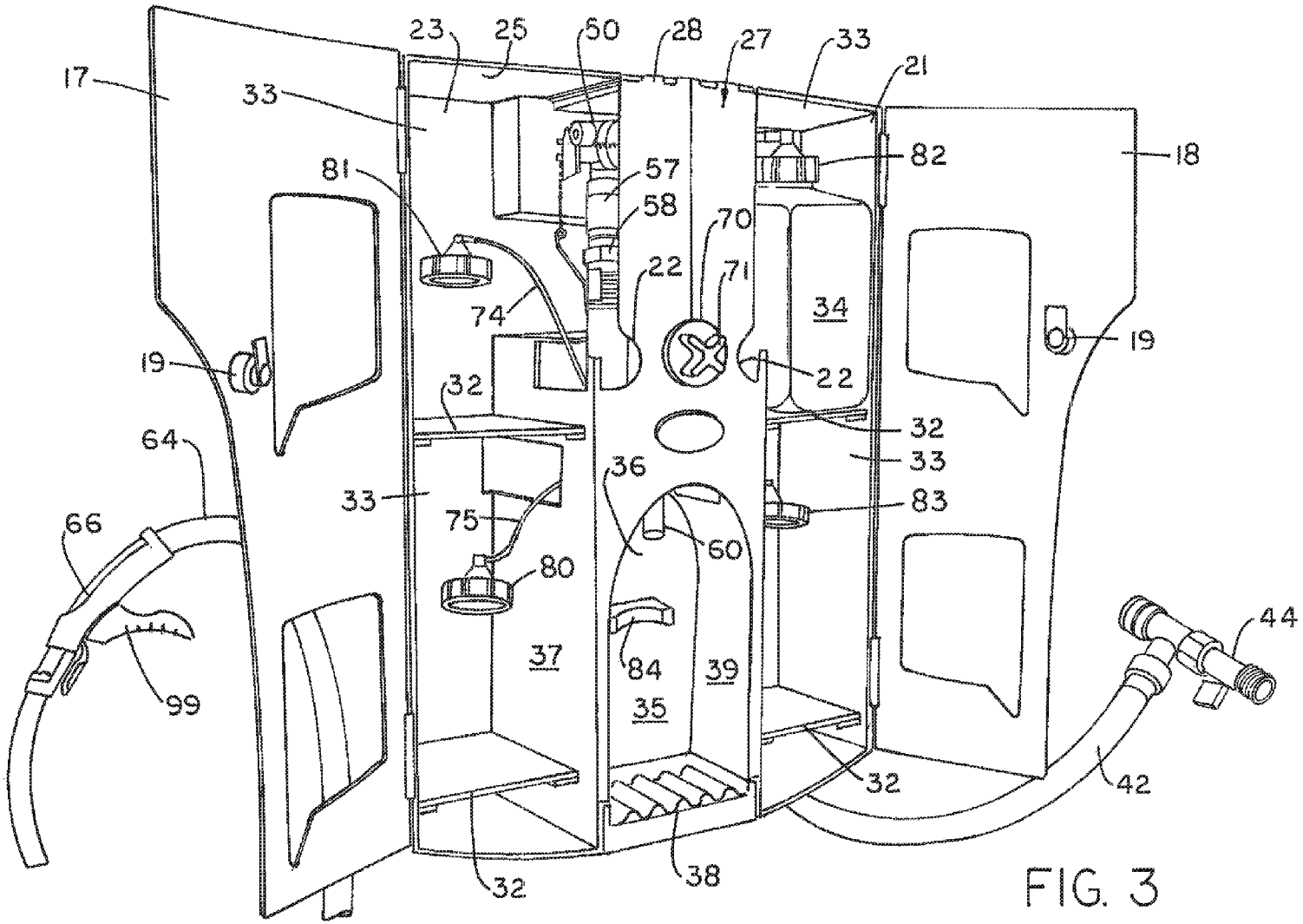
FIG. 3 is an enlarged view of the cabinet similar to FIG. 2.

Referring to FIGS. 1-3, the mixing and dispensing apparatus generally 10 includes a cabinet member 12 which provides a housing 16 composed of two hinged doors 17 and 18 connected to side panels 20 and 21, respectively. The housing also includes a rear wall 23 and a top wall 25. There are slots such as 24 in the rear wall 23 to afford connection to a wall by means of screws or bolts. There is also a central section generally 27 formed with walls 37 and 39. There are flanges 29 and 30 extending from walls 37 and 39 as well as from side panels 16 and 21 to provide a support for plates 32. These plates 32 inside cabinet 12 provide pockets 33 for supporting containers such as 34 for liquid chemical concentrate. Bottom panels 26 and 31 connect side walls 37 and 39 with side panels 20 and 21, respectively. There is also a hinged panel 28 connected to top wall 25.

Figure 4:
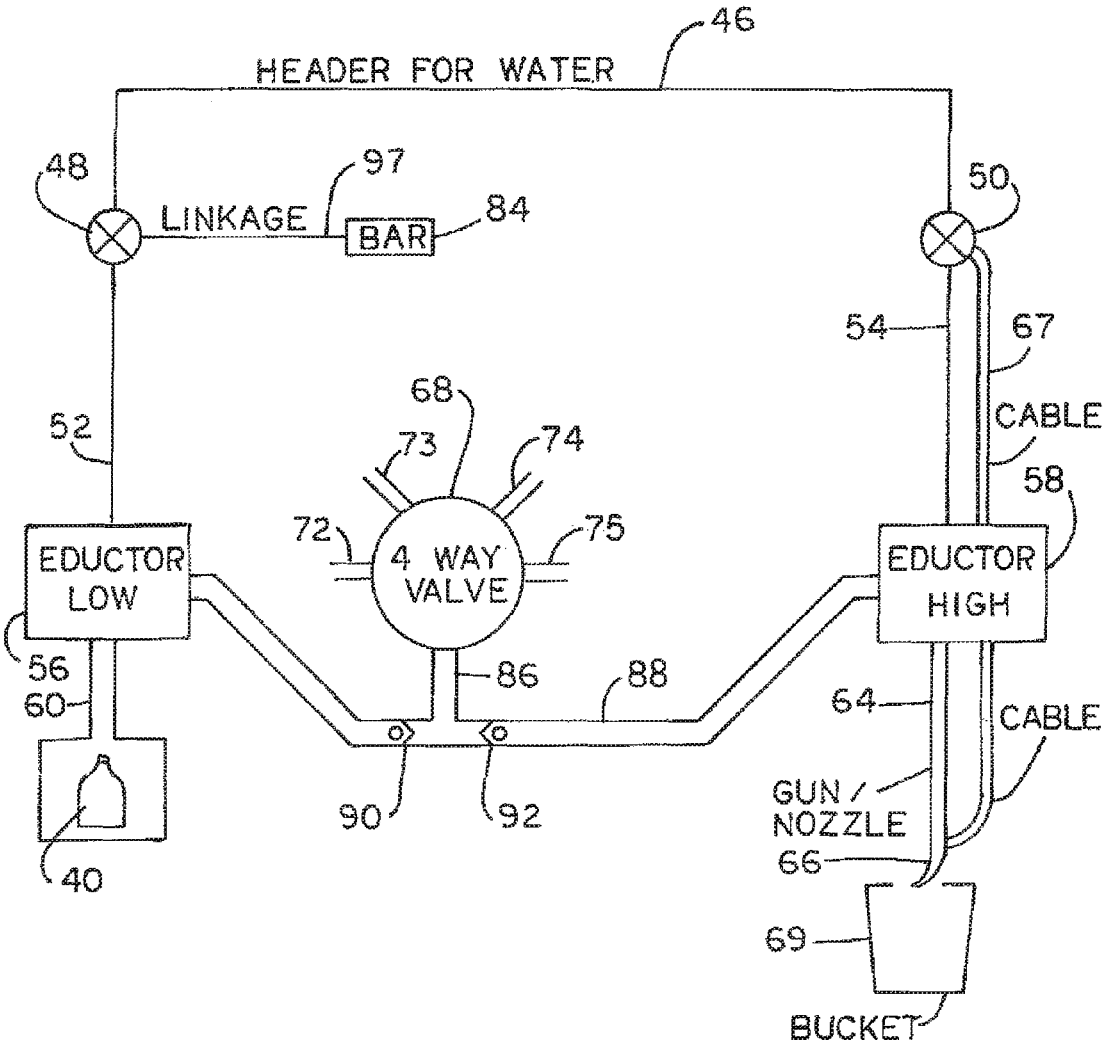
FIG. 4 is a diagrammatic view illustrating the supply and control system for the dispensing apparatus.

There is an additional alcove-like pocket 36 in central section 27 with a drip tray 38 which is slideably supported and positioned at the bottom thereof. It affords support for a liquid container 40 as shown in FIG. 4. Alcove pocket is provided by back wall 35 and side walls 37 and 39.

Referring to FIGS. 2, 3 and 4, there is a water supply hose 42 with a filter valve 44 for supplying water to the header 46 in the customary manner. There are two valves 48 and 50 connected to the header 46. Water supply line 52 supplies water to a low flow rate eductor 56 whereas water supply line 54 supplies high flow rate to eductor 58. The preferred eductors 56 and 58 are those described in commonly owned U.S. patent application Ser. No. 11/195,052 filed Aug. 2, 2005, which teachings are incorporated herein by reference. An outlet line 60 conveys product from eductor 56 to container 40. Similarly hose outlet line 64 and gun/nozzle 66 convey product to bucket 69. The gun of gun/nozzle 66 is connected to cable 67 which is also connected to valve 50. Gun nozzle 66 as well as valve 50, are described in U.S. Pat. No. 6,299,035, which teachings are incorporated herein by reference.

A four-way valve 68 is connected to eductors 56 and 58 and positioned inside central section 27. It is controlled by knob 70. There are four product inlet lines 72, 73, 74 and 75 connected to the four-way valve 68 as well as to container caps 80, 81, 82 and 83, respectively. The preferred four-way valve 68 is described in commonly assigned U.S. patent application Ser. No. 60/707,399 filed Aug. 11, 2005, which teachings are incorporated herein by reference. There is an outlet line 86 interconnected with common line 88 as well as eductors 56 and 58. Two check valves 90 and 92 are positioned in line 88, for purposes as will be explained later in the Operation.

Figure 5:
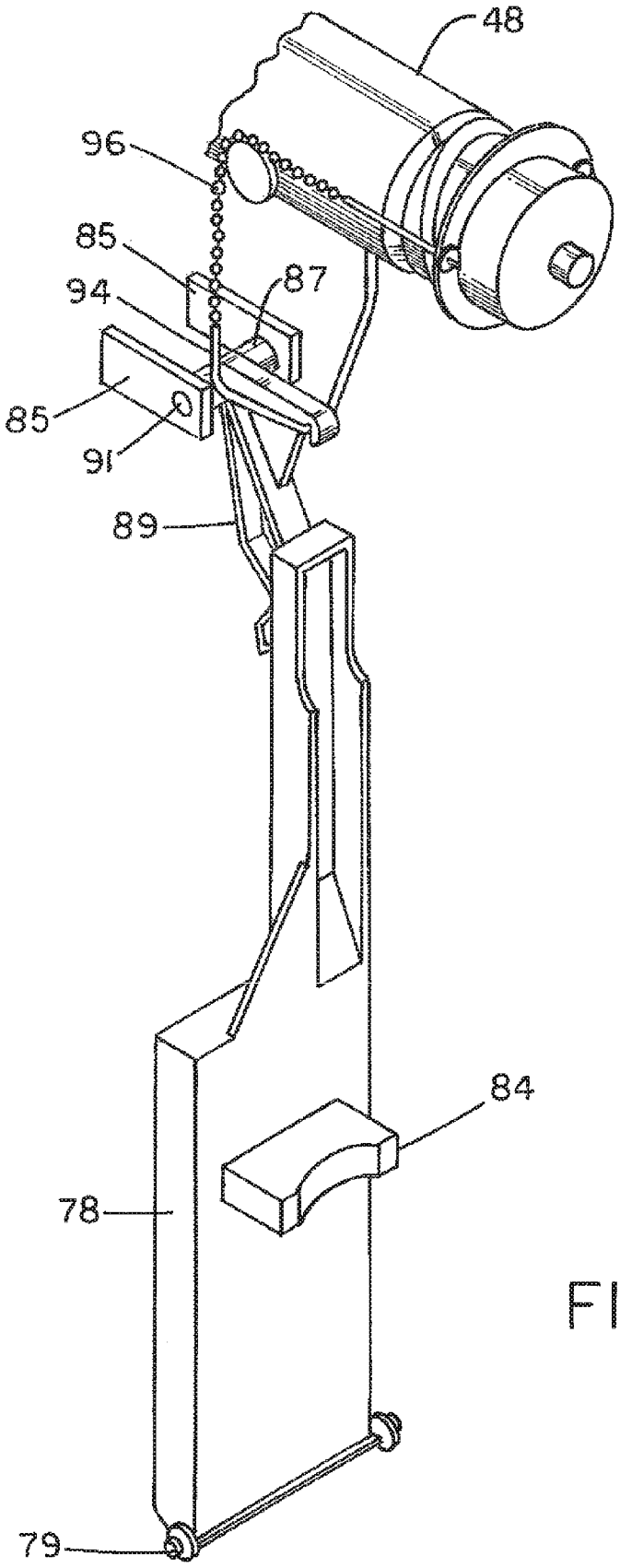
FIG. 5 is a perspective view of the linkage for activating one of the valves.
Figure 6:
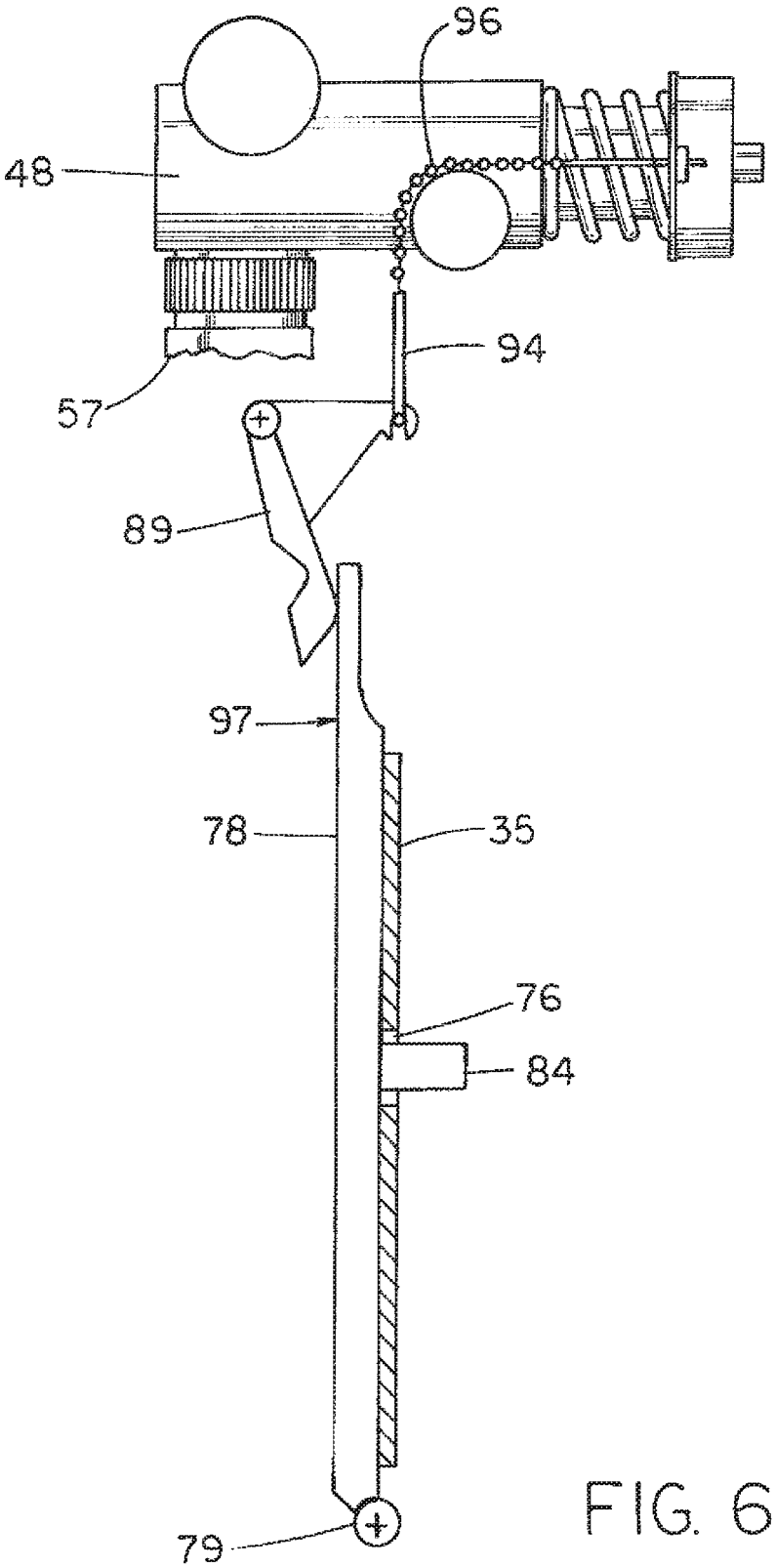
FIG. 6 is a side view of the linkage shown in FIG. 5 illustrating the linkage in a non-operative condition.
Figure 7:
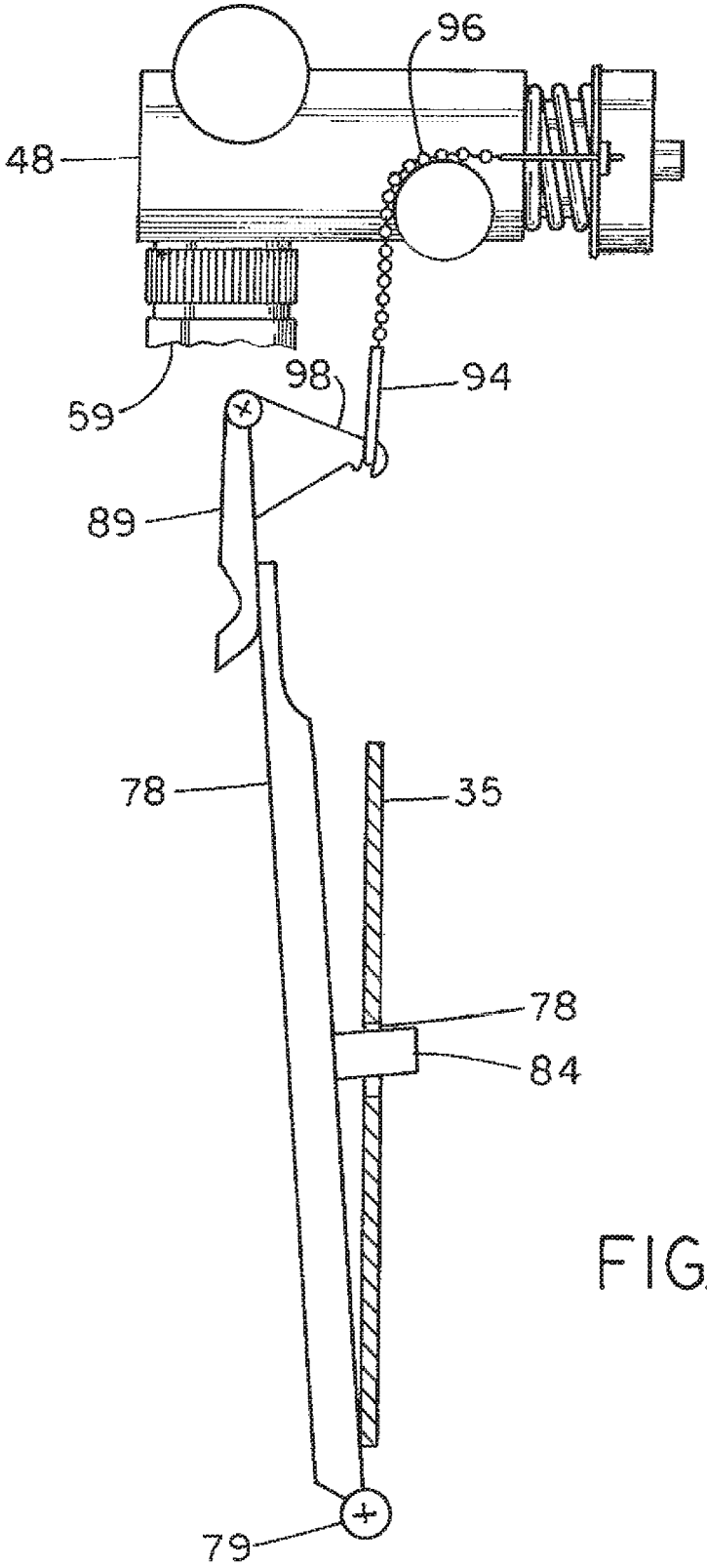
FIG. 7 is a view similar to FIG. 6 showing the linkage in an operative condition.

As seen in FIGS. 5, 6 and 7, a bottle contact bar 84 extends through opening 76 in alcove back wall 35. Bar 84 extends from arm 78 pivotally connected at 79 to flanges (not shown) extending from the bottom of alcove side walls 37 and 39. Arm 78 contacts crank portion 89 pivotally attached at 91 by trunion 87 to flanges 85 connected to rear wall 23 (see FIG. 3). Yoke 94 connects pull chain 96 to valve 48 in the manner described in U.S. Pat. No. 6,299,035. The previously described components comprise the linkage 97 for actuating valve 48.

Operation

A better understanding of the dispensing apparatus will be had by a description of its operation. Referring to FIG. 3, containers with chemical concentrate such as shown at 34 are placed in pockets such as 33 in cabinet 12 and connected to caps 80, 81, 82 and 83. Each container will preferably contain a different chemical concentrate. Doors 17 and 18 are closed and latched such as by latches 19 engaging cut outs 22 in central support section 27. Filter valve 44 is connected to a source of pressurized water which causes water to flow to header as seen in FIG. 4. The operator then selects which of the chemical concentrates is to be diluted and educted by means of knob 70 and pointer 71.

The pointer 71 of a knob 70 is directed toward which container in which pocket 33 is to be activated by means of the four way valve 68. The operator then determines whether a bottle 40 is to be filled with the diluted chemical concentrate or a bucket 69.

If a bottle 40 is to be filled, it is placed in alcove pocket 36. Placement of bottle 40 therein presses against bar 84 which by means of linkage 97 activates valve 48 as shown in FIG. 7. Activation is effected by arm 78 moving away from wall 35 which causes arm 98 of crank portion 89 to move downwardly. This exerts a pulling effect on connector 94 and chain 96 to open valve 48. This causes pressurized water to flow into low flow rate eductor 56. At the same time, reduced pressure is effected in lines 88 and 86 as well as one of the conduit lines 72-75 depending upon which is selected by the operator by means of the four-way valve 68. In this instance check valve 90 opens whereas check valve 92 closes so there is no siphoning effect beyond line 86 and eductor 58. Diluted chemical concentrate flows through outlet line 60 into bottle 40. Once bottle 40 is filled with diluted concentrate, it is removed from the alcove pocket 36 which releases the force on bar 84 and closes valve 48. This is shown in FIG. 6.

If a bucket 69 is to be filled with diluted chemical concentrate, gun nozzle 66 is activated by pressing lever 99 (see FIG. 3). This creates a pulling force on cable 67 to activate valve 50 which causes pressurized water to flow into high flow rate eductor 58. A siphoning action is effected in outlet lines 88 and 86 with an opening of check valve 92 and a closing of check valve 90. This in turn draws chemical concentrate from one of the conduit lines 72-75 and accordingly the selected container 34. When the lever is released, valve 50 closes and the previously described siphoning action ceases.

It will thus be seen that there is now provided a mixing and dispensing apparatus which affords ease of dispensing. Once the selector knob 70 is moved to a position to select the desired chemical concentrate, all that is required to activate the dispenser 10 is to place a bottle 40 in alcove 36 and against bar 84. This is accomplished with one hand. The same advantages pertain to filling bucket 69. All that is required is a selection of the desired concentrate by means of selector knob 70 and four-way valve 68, and a pressing of lever 99 of gun nozzle 66. This also affords remote bucket filling.

Other important features of the dispenser 10 are latches 19 which are key locks and afford a locking of the doors 17 and 18. This is seen in FIG. 3. The doors 17 and 18 are composed of stainless steel or powder coated mild steel whereas the cabinet is composed of durable molded ABS plastic. This affords a reduced maintenance dispenser. Product identification is easily made through windows 15.

The cabinet 12 affords on-wall repair, compatibility with multiple packages, in field retrofit as well as quick connect of serviceable components and improved ergonomics. Hinged panel 28 provides ready access to the eductors 56 and 58 which are connected to panel 61. Eductors 56 and 58 are connected to valves 48 and 50 by a Gardena connector 57 such as illustrated in FIG. 3. This provides ease of connection or disconnection. If desired, a battery powered indicator light could be employed in conjunction with knob 70 and pockets 33 to indicate which chemical concentrate is selected for dispensing.

Particular magnetic, pull-chain operated valves 48 and 50 are employed in conjunction with linkage 97 and gun/nozzle 66. Any valve which can be linkage or cable operated could be substituted. While eductors 56 and 58 are of the non-air gap type, depending on plumbing codes, air gap eductors can be employed such as that described in U.S. Pat. No. 5,927,338 and U.S. Pat. No. 6,279,598. A four-way valve 68 is described for use in conjunction with dispenser 10. If desired, a valve with any number of product inlet lines could be used depending on the size of the cabinet 12. All such and other modifications within the spirit of the invention are meant to be within its scope, as defined by the appended claims.

What is claimed is:

1. A method of mixing and dispensing liquids, the method comprising:

placing a valve in a first state;

drawing a first chemical concentrate through one of a first eductor and a second eductor only from a first source while the valve is in the first state;

changing the valve from the first state to a second state; and drawing a second chemical concentrate through the second eductor only from a second source while the valve is in the second state.

2. The method of claim 1, further comprising drawing the second chemical concentrate through the first eductor only from the second source while the valve is in the second state.

3. The method of claim 1, wherein changing the valve from the first state to the second state comprises rotating a valve assembly using a knob.

4. The method of claim 1, wherein:

the first chemical concentrate is ready for dispense from either or both of the first and second eductors when the valve is in the first state; and the second chemical concentrate is ready for dispense from either or both of the first and second eductors when the valve is changed from the first state to the second state.

5. The method of claim 1, further comprising indicating to a user that the first chemical concentrate will be dispensed when the valve is in the first state.

6. The method of claim 5, wherein indicating to the user comprises pointing to the first source.

7. The method of claim 1, further comprising connecting the first source to the first and second eductors via fluid lines extending from the first source to both of the first and second eductors.

8. The method of claim 1, further comprising connecting the valve to the first and second eductors via fluid lines extending from the first source to both of the first and second eductors.

9. The method of claim 1, further comprising supporting the first and second sources in respective locations within a cabinet.

10. The method of claim 9, further comprising exposing at least a portion of the first source to the view of a user from outside of the cabinet.

11. A method of mixing and dispensing liquids, the method comprising:

establishing fluid communication between a first source of chemical concentrate and an eductor with a knob in a first orientation;

indicating to a user that the first source of chemical concentrate is ready for dispense while the knob is in the first orientation;

turning the knob from the first orientation to a second orientation;

establishing fluid communication between a second source of chemical concentrate and the eductor with the knob in the second orientation;

indicating to a user that the second source of chemical concentrate is ready for dispense while the knob is in the second orientation; and dispensing the first source of chemical concentrate or the second source of chemical concentrate through one of two outlets based on the orientation of the knob.

12. The method of claim 11, further comprising changing the state of a valve by turning the knob.

13. The method of claim 11, wherein providing an indication to the user that the first source of chemical concentrate will be dispensed comprises pointing to the first source of chemical concentrate.

14. The method of claim 13, wherein pointing to the first source of chemical concentrate comprises pointing to the first source of chemical concentrate with a portion of the knob.

15. The method of claim 11, wherein the eductor is a first eductor, the method further comprising establishing fluid communication between the first source of chemical concentrate and a second eductor with the knob in the first orientation.

16. The method of claim 11, further comprising turning the knob to a plurality of different orientations each corresponding to a respective chemical concentrate positioned circumferentially about the knob.

17. The method of claim 12, further comprising connecting the valve to both of the first and second sources of chemical concentrate with respective fluid lines.

18. The method of claim 11, further comprising dispensing the first chemical concentrate at two different rates selected by the user.

19. The method of claim 11, further comprising supporting the first and second sources in respective locations within a cabinet.

20. The method of claim 19, further comprising exposing at least a portion of the first source to the view of a user from outside of the cabinet.

* * * * *